US006217289B1

(12) United States Patent
Smith

(10) Patent No.: US 6,217,289 B1
(45) Date of Patent: Apr. 17, 2001

(54) AXIAL PISTON PUMP WITH AUXILIARY PUMP

(75) Inventor: Brian William Smith, Wooster, OH (US)

(73) Assignee: The Rexroth Corporation, Wooster, OH (US)

( * ) Notice: Subject to any disclaimer, the term of this patent is extended or adjusted under 35 U.S.C. 154(b) by 0 days.

(21) Appl. No.: 09/645,257

(22) Filed: Aug. 24, 2000

Related U.S. Application Data

(63) Continuation-in-part of application No. 09/553,285, filed on Apr. 20, 2000.

(51) Int. Cl.[7] ..... F04B 23/08
(52) U.S. Cl. ..... 417/199.1; 417/269; 92/71
(58) Field of Search ..... 417/199.1, 269; 92/71

(56) References Cited

U.S. PATENT DOCUMENTS

| | | | | |
|---|---|---|---|---|
| 3,450,058 | * | 6/1969 | Stein | 92/71 |
| 5,191,867 | | 3/1993 | Glassey . | |
| 5,515,829 | | 5/1996 | Wear et al. . | |
| 5,784,949 | * | 7/1998 | Ryken et al. | 92/57 |
| 5,788,469 | | 8/1998 | Novacek et al. . | |
| 5,862,704 | * | 1/1999 | Seljestad | 417/269 |
| 5,957,111 | | 9/1999 | Rodier . | |
| 6,092,998 | * | 7/2000 | Dexter et al. | 417/360 |

OTHER PUBLICATIONS

SAE Technical Paper 2000–01–0687, entitled "Development of a Variable–Desplacement, Rail–Pressure Supply Pump for a Dimethyl Ether" by James C. McCandless, Ho Teng and Jeffrey B. Schneyer presented Mar. 6–9, 2000.

* cited by examiner

*Primary Examiner*—Charles G. Freay
(74) *Attorney, Agent, or Firm*—Frank J. Nawalanic

(57) ABSTRACT

An axial piston pump has a rotatable input shaft integral with a rotatable swash plate. A non-rotatable cylinder contains a plurality of axially movable pistons having spherical ends extending through the cylinder journaled in slipper assemblies that are in contact with the swash plate. A retainer plate in contact with the slipper assemblies is spring biased to urge the slippers against the swash plate to maintain the swash plate in fixed axial position. The input shaft is journaled only by a sleeve bearing while an annular thrust bearing plate between pump housing and a swash plate axial end allows for swash plate rotation within the pump housing. The swash plate has a cam shaped circumferential edge surface. An auxiliary pump having a prime mover in contact with the cam shaped edge of the swash plate is mounted between the axial ends of the piston pump.

14 Claims, 3 Drawing Sheets

AXIAL PISTON PUMP WITH AUXILIARY PUMP

This patent application is a continuation-in-part of application Ser. No. 09/553.285, filed on Apr. 20, 2000, pending and incorporated herein by reference.

This invention relates to axial piston pumps and more particularly to the combination of an axial piston pump with an auxiliary pump mounted thereto.

INCORPORATION BY REFERENCE

The parent patent application Ser. No. 09/553,285 is hereby incorporated by reference in its entirety both for the description of the axial piston pump disclosed therein, specifically the valving employed therein, and to which this invention is an improvement thereof and for the HEUI pump application disclosed therein because this invention has particular application for use in an HEUI system.

BACKGROUND

Conventional axial piston pumps (i.e., "Thoma" pump) are often used in high pressure applications. For example, in a hydraulically actuated electronically controlled united injector (HEUI) fuel control system, a high pressure, axial piston oil pump typically supplies the diesel injectors with 3,000–4,000 psi engine oil for hydraulic operation. This high pressure oil pump is charged with low pressurized fluid from another pump, typically the engine's oil pump. Conventionally, an auxiliary pump, the engine's fuel pump, is driven by the HEUI pump. The fuel pump transfers fluid from the fuel tank to the injectors for consumption by the engine and typically pumps at approximately 20–50 psi.

In many of these applications, the high pressure pump also drives a low pressure pump. A typical arrangement is illustrated in prior art FIG. 1 in which an input shaft 10 is splined to a rotatable cylinder 12 having circumferentially spaced bores containing pistons 13. One end of each piston is ball shaped and received in a socket receptacle formed as a slipper 14 which, in turn, contacts an end face of a stationary swash plate 15. Rotation of Input shaft 10 rotates cylinder 12 to cause pistons 13 to axially reciprocate in their bores by slipper contact with swash plate 15 while fluid intake and exhaust of pressurized fluid is through conventional kidney shaped intake/outtake ports 16. Press fitted onto the tail end of input shaft 10 is a cam 18 which acts as an eccentric to drive a prime mover 19 of an auxiliary pump 20.

In vehicular applications, space is at a premium and is often a determining factor in the OEM's selection process, especially for mature technologies such as that embodied in an axial piston pump. In the arrangement illustrated in FIG. 1, the addition of auxiliary pump 20 onto the tail end of input shaft 10 increases the length of the pump assembly. A more subtle point is that an eccentric lift is provided at a tail extension of the input shaft which requires that the input shaft be soundly journaled so as not only to unduly transmit loads to the high pressure pump but also to insure against any axial run out of the shaft which could potentially adversely affect the smoothness of the lift motion of prime mover 19, especially if cam 18 wears. In the prior art pump of FIG. 1, front and rear ball bearings 21 journal input shaft 10 and internal and external retainer rings 22, 23 (lubricated) prevent shaft run out. The FIG. 1 arrangement has proven to be durable and commercially acceptable. Its length, however, is increased by auxiliary pump 20 and its cost must reflect the bearing arrangement.

In SAE Technical Paper 2000-01-0687, entitled "Development of a Variable-Displacement, Rail-Pressure Supply Pump for a Dimethyl Ether" by James C. McCandless, Ho Teng and Jeffrey B. Schneyer presented Mar. 6–9 2000, an axial piston pump is disclosed in which, like the parent application, a rotating swash plate/stationary cylinder is disclosed. In the pump disclosed in the SAE paper, the circumferential edge of the swash plate is used to control valving to the axial piston pump. Like FIG. 1, the input shaft of the SAE disclosed pump is journaled in ball bearings. Additionally, springs in the piston bores are used to maintain slippers in contact with the swash plate.

SUMMARY OF THE INVENTION

Accordingly, it is a principal object of the present invention to provided an axial piston pump configuration which allows for inclusion of an auxiliary pump without increasing axial pump length while minimizing cost of the pump.

This object along with other features of the invention is achieved in a pump assembly which includes an axial piston pump having a swash plate rotatable by an input shaft and a non-rotatable cylinder containing a plurality of axially movable pistons having spherical ends extending through the cylinder journaled in slipper assemblies that are in contact with the swash plate. A retainer plate in contact with the slipper assemblies is spring biased to urge the slippers against the swash plate to maintain the swash plate in fixed axial position and permit smooth swash plate rotation not withstanding varying force pulsations attributed to fluid pressure in the piston bores during pump operation. The swash plate has a cam shaped circumferential edge surface. An auxiliary pump having a prime mover in contact with the cam shaped edge of the swash plate is mounted between the axial ends of the piston pump whereby the length of the piston pump assembly is maintained constant.

In accordance with another aspect of the invention, the swash plate has one axial end generally perpendicular to the longitudinal centerline of the input shaft and an opposite swash end inclined at an angle to the longitudinal centerline with the cam edge extending between the swash plate ends. The piston pump has a housing containing a cylindrical shaft inlet passage at one axial end terminating in an intermediate or swash plate chamber containing the swash plate. The intersection of the intermediate chamber and the inlet passage defines an annular seat surface and a Teflon coated thrust plate between the annular seat surface and the axial end of the swash plate functions as a thrust bearing allowing swash plate rotation without grapping or seizing resulting in smooth operation of the secondary pump. The input shaft is only journaled within a similar, Teflon coated sleeve bearing pressed into the cylindrical shaft inlet passage thus eliminating bearing assemblies and retainer rings and the like.

It is thus an object of the present invention to provide an axial piston pump capable of driving an auxiliary pump without increasing the axial length of the pump.

It is another object of the invention to provide an axial piston pump which journals the input shaft and swash plate without the need for bearing assemblies, bearing races, retainer rings and the like.

It is another object of the invention to provide the combination of a high pressure axial piston pump and a low pressure pump ideally suited for HEUI and like applications.

It is yet another object of the invention to provide a low cost axial piston pump especially suited for driving an auxiliary pump.

These and other features, objects and advantages of the present invention will become apparent to those skilled in the art upon reading and understanding the Detailed Description of the Invention set forth below.

BRIEF DESCRIPTION OF THE DRAWINGS

The invention may take form in certain parts and arrangement of parts, a preferred embodiment of which will be described in detail and illustrated in the accompanying drawings which form a part hereof and wherein.

DETAILED DESCRIPTION OF THE INVENTION

Figure 1:
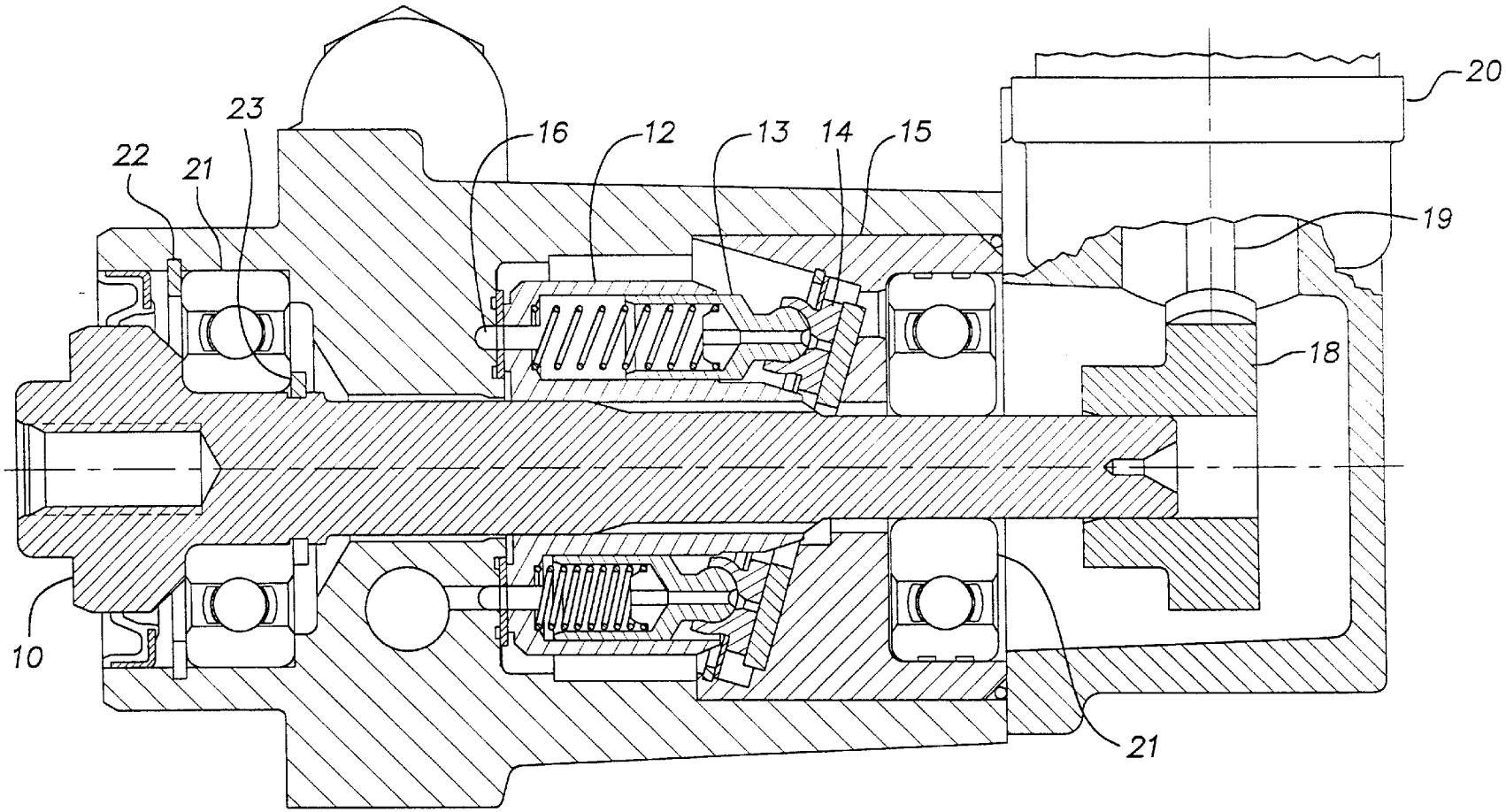
FIG. 1 PRIOR ART
FIG. 1 is a longitudinally sectioned view of a prior art axial piston pump fitted with an auxiliary pump.
Figure 2:
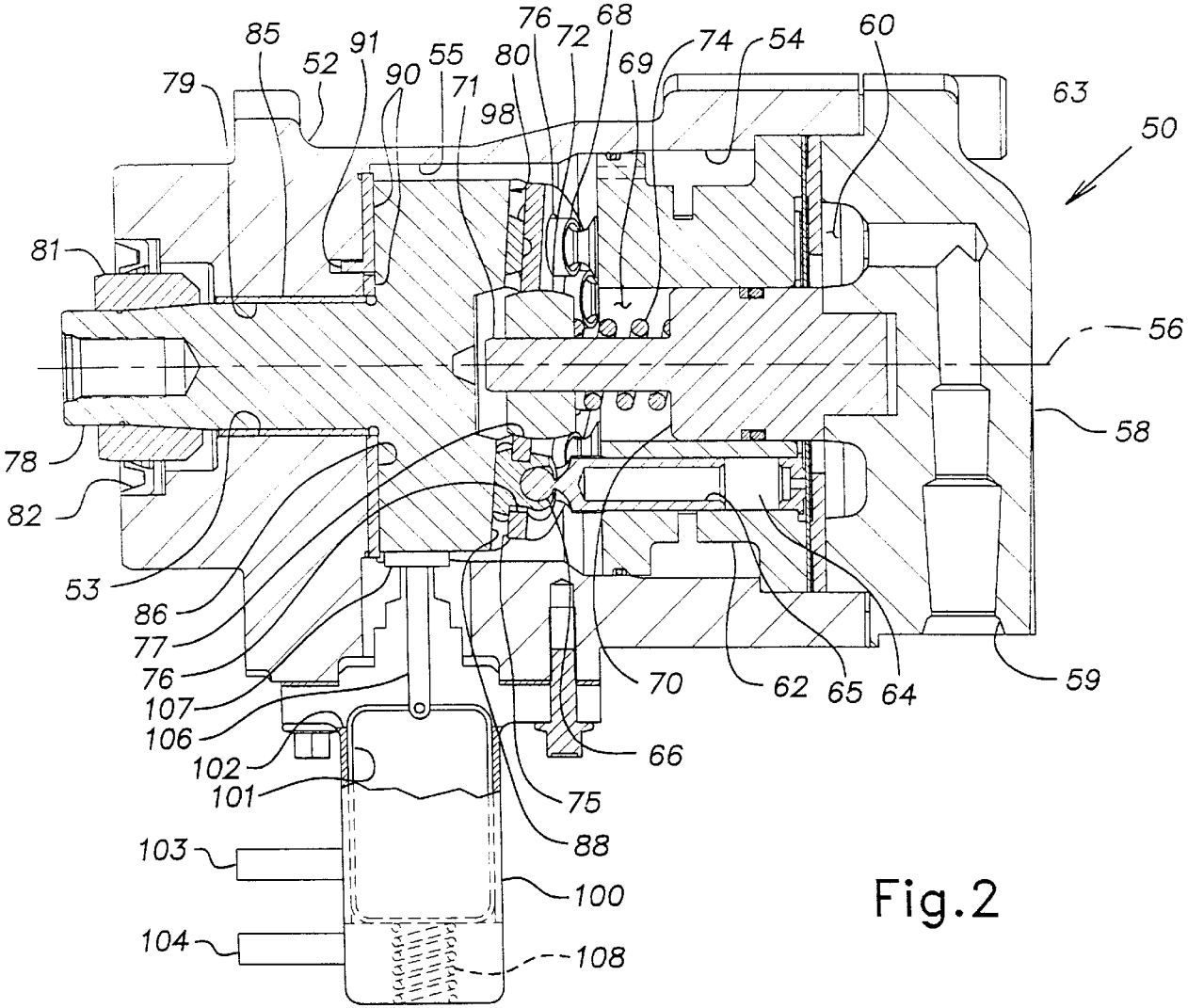
FIG. 2 is a sectioned side elevation view of the fixed displacement axial piston pump of the present invention shown with an auxiliary pump mounted thereto; and, FIG. 3 is a sectioned elevation view of the pump of the present invention similar to that shown in FIG. 2 but through a section of the pump rotated about 90° to the pump section shown in FIG. 2.
Figure 3:
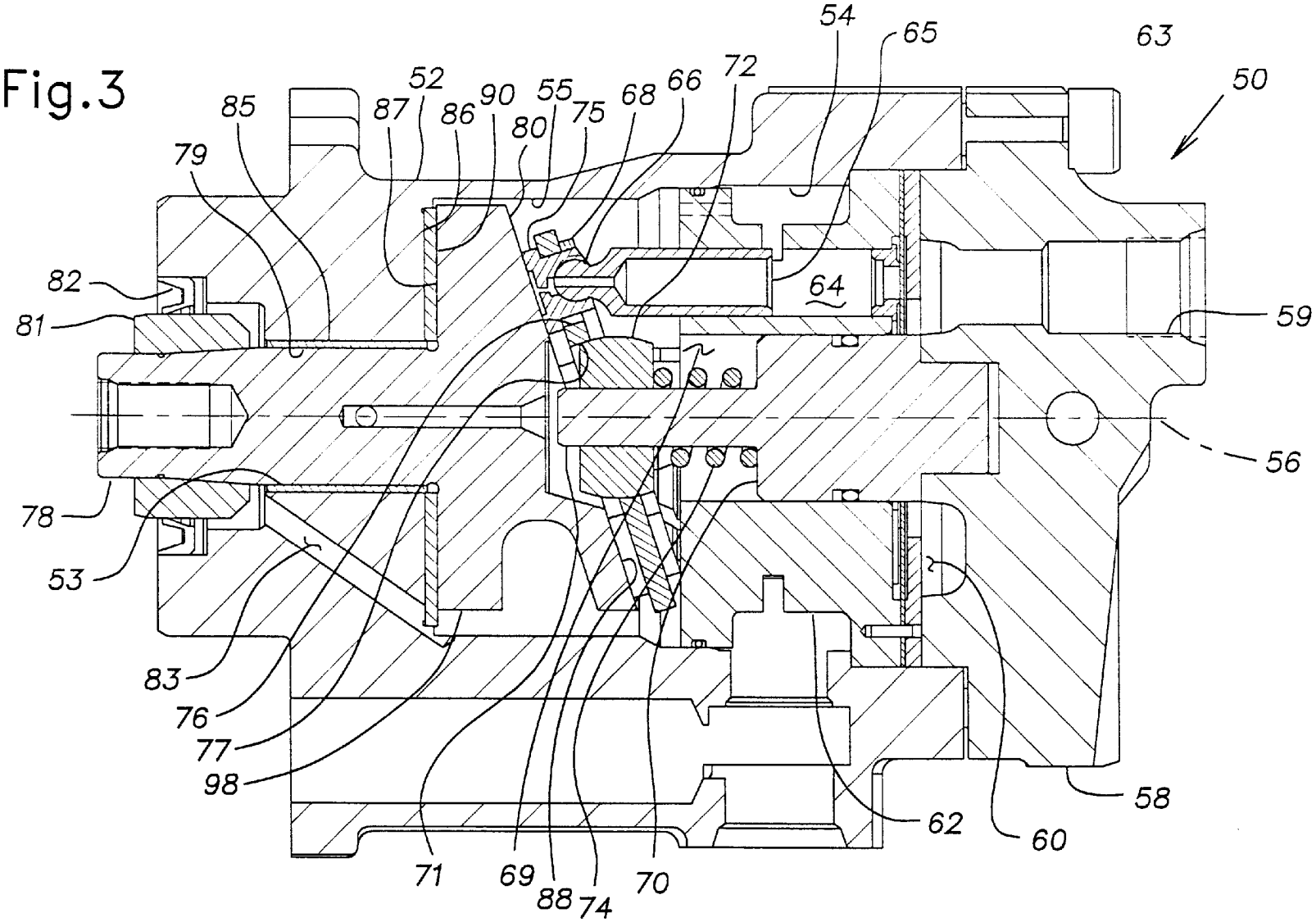

Referring now to the drawings wherein the showings are for the purpose of illustrating a preferred embodiment of the invention only and not for the purpose of limiting same, there is shown in FIGS. 2 and 3 an axial piston pump 50 of the present invention.

Axial piston pump 50 includes an open ended pump housing 52. In the preferred embodiment, pump housing 52 is a unitary casting but in accordance with the broader scope of the invention can comprise a composite assembly having the desired configuration. Pump housing 52 has at one axial end an inlet shaft passage 53, at its opposite axial end a cylinder chamber 54 and interconnecting inlet shaft passage 53 with cylinder chamber 54 is an intermediate or swash plate chamber 55. Inlet shaft passage 53, cylinder chamber 54 and swash plate chamber 55 extend along and are generally concentric about longitudinal centerline 56. Closing cylinder chamber 54 is an end plate 58 which in the preferred embodiment is a casting. End plate 58 has formed therein a pump outlet 59 which is in fluid communication with an annular pump discharge chamber 60.

Disposed within cylinder chamber 54 is an annular cylinder 62 which is made non-rotatable in the preferred embodiment by the clamping force between end plate 58 and pump housing 52 exerted by cap screws 63 when the pump is assembled. Extending through the ring body of cylinder 62 is a plurality of circumferentially spaced piston bores 64 each of which contains a piston 65 axially movable therein. One end of each piston 65 extends through each piston bore 64 and is formed in the shape of a ball 66. Each ball 66 is received within a socket formed in a slipper 68 so that the ball socket joint allows each slipper 68 to pivot omnidirectionally.

Inserted within the central opening 69 of cylinder 62 is a cylindrical tail shaft 70 which has a cylindrical stem portion 71. Stem portion 71 receives an annular spherical bearing 72 which has its outside diametrical surface formed as a sphere. A compression spring 74 fits over stem portion 71 and seats on tail shaft 70 as shown so that its biasing force tends to push spherical bearing 72 off tail shaft 70. Spherical bearing 72 is maintained in its position by an annular retainer plate 75 having a plurality of circumferentially spaced slipper openings 76 which engage or fit within a stepped flange formed in slippers 68. The central opening 77 of retainer plate 75 has a through diameter slightly less than the spherical diameter of spherical bearing 72 so that retainer plate 75 holds spherical bearing 72 at its axial position on stem portion 71 with the axial force of spring 74 transmitted to slippers 68. The surface of central opening 77 is dished or curved at a spherical diameter equal to or greater than the spherical diameter of spherical bearing 72 so that retainer plate 75 can wobble or pivot about the outside spherical surface of spherical bearing 72 as pistons 65 axially move within piston bores 64.

An inlet shaft 78 has an inlet shaft portion 79 within inlet shaft passage 53 and a swash plate portion 80 within swash plate chamber 55. In the preferred embodiment inlet shaft 78 is a unitary structure having the shaft and swash plate portions as described but portions 79, 80 can be separate and integrally secured to one another. Pressed on to the end of inlet shaft portion 79 is a hub 81 (for a gear mount used in the preferred embodiment - not shown) for rotating inlet shaft 78 and sealed by a shaft seal 82. Hub 81 is optional and inlet shaft 78 could be straight with shaft seal 82 riding directly on it or alternatively be a keyed or splined shaft. Shaft seal 82 is lubricated by a lubricating groove 83. Inlet shaft portion 79 is journaled for rotation about a sleeve bearing 85 extending along a substantial portion of the length inlet shaft portion 79. In the preferred embodiment, sleeve bearing 85 is a conventional sleeve bearing preferably a steel cylinder, the interior of which is coated with an annular lead/bronze composite wear metal and, the interior of the wear material, in turn, is coated with Teflon. Other conventional bearing materials may be used.

Pump housing 52 at the intersection of inlet shaft passage 53 with swash plate chamber 55 forms a flat annular seat surface 86. Swash plate portion 80 at one axial end has an annular flat end surface 87 generally perpendicular to longitudinal centerline 56, and at its opposite axial end has a swash plate surface 88 which is at an angle to longitudinal centerline 56. In between housing annular seat surface 86 and swash plate end surface 87 is a non-rotatable, annular thrust bearing plate or washer 90. In the preferred embodiment, thrust bearing 90 is an annular steel plate having one side seated against housing annular seat surface 86 and its other side coated with a composite lead/bronze metal which in turn is coated with Teflon against which swash plate end surface 87 seats. In the preferred embodiment, thrust bearing washer 90 is made non-rotatable by a discrete slit punched through thrust bearing washer 90 to form a tab 91 which fits in a tab recess formed in housing seat surface 86. Alternatively, thrust bearing washer 90 could be made non-rotational by any number of arrangements such as dowel pin, screw, adhesive, etc.

The operation of pump 50 is opposite to that of a conventional Thoma pump. Rotation of inlet shaft 78 causes swash plate portion 80 to rotate axially moving swash plate surface 88 relative to piston bores 64 which are stationary.

Slippers 68 cause pistons 65 to axially move within piston bore 64. Fluid form an inlet port 93 is drawn into piston bore 64 through a suction slot 94 during the suction stroke of piston 65. When piston 65 axially travels forward in piston bore 64, communication of suction slot 94 is cut off and compressed fluid exits piston bore 64 through a valved outlet shown, in the preferred embodiment, as a read-valve 95 into discharge chamber 60 and out through pump outlet 59. Note that while most pumps can function as a motor, pressurizing inlet port 93 will not produce rotation of inlet shaft 78.

It is to be noted that there are no ball bearings, tapered bearings, roller bearings and the like having bearing races etc. used in pump 50. The entire arrangement is journaled at one point but the point extends a substantial length of inlet shaft 78 as a sleeve bearing (85) which works in combination with thrust bearing 90 to stably support the pump. That is, by making swash plate portion 80 integral with inlet shaft portion 79 and spring biasing swash plate portion 80 to contact housing annular seat surface 88, axial runout is controlled without the need for bearing retainer rings and assembly of the pump is simplified.

It is to appreciated that the pressure within piston bores 64 during the compression stroke of the pump will generate a pulsating force on swash plate surface 88 which will rotate with the rotation of swash plate portion 80. This pulsation stresses conventional bearings and could lead to shaft wobble. An obvious, conventional arrangement is to insert a compression spring in each piston bore such as shown in the SAE paper discussed above. However, while piston bore springs can be sized to exert a force on the swash plate during the suction stroke, a greater spring force will be exerted during the compression stroke increasing the pulsation force. The slipper/retainer plate/spring arrangement discussed above exerts a constant force about all of the slippers. By simply sizing spring 74, uniform contact with thrust bearing washer 90 throughout the washer area is assured. Pulsations will still inevitably occur but they won't be enhanced or increased as a result of compression springs in piston bores 64. A smoother pump operation will result and the bearing arrangement will be better stabilized. Shaft axial runout or shaft wobble is less likely to occur.

With stable rotation of swash plate portion 80 assured, the outer circumferential edge 98 of swash plate portion 80 between swash plate surface 88 and swash plate thrust bearing surface 87 can be formed as a cam surface (eccentric). A typical example of an auxiliary pump mounted to axial piston pump 50 is schematically illustrated in FIG. 2. It is to be appreciated that the auxiliary pump can be used to pressurize any number of fluid systems, the fuel pump of a HEUI system being only one example. In fact the auxiliary pump can be used to supply low pressure fluid to inlet port 93. The auxiliary pump may comprise a radial piston pump 100 in which the pump's prime mover or pumping element, in this case piston 101, axially moves in a cylinder 102 to sequentially open and close an inlet port 103 to pump fluid through an outlet port 104. Prime mover 101 is actuated by a crank 106 pivoted at one end to prime mover 102 and having a cam follower 107 at its opposite in contact with cam 98. A spring 108 can be provided to assure cam follower contact with cam 98. In each instance, the auxiliary pump would be actuated by a cam follower 107 providing a stroke to an appropriate linkage that would actuate or stroke the pump. Significantly, auxiliary pump 100 is between the axial ends of axial piston pump 50 thus minimizing the length of the pump arrangement. The journal/thrust bearing arrangement for the input shaft/swash plate in combination with the spring/retainer plate/slipper arrangement, while an inexpensive arrangement, produces a smoothly rotating swash plate minimizing the effects of axial pulsations on the rotation of swash plate and resulting in smooth performance of the auxiliary pump.

The invention has been described with reference to a preferred embodiment. Obviously, alterations and modifications will occur to those skilled in the art upon reading and understanding the Detailed Description of the Invention set forth herein. It is intended to include all such modifications and alterations insofar as they come within the scope of the present invention.

Having thus defined the invention it is claimed:

1. A pump assembly comprising:

a) an axial piston pump including a swash plate rotatable by an input shaft; a non-rotatable cylinder containing a plurality of piston bores, each bore having an axially movable piston with a spherical end extending through the cylinder journaled in a slipper in contact with a swash plate; a spring biased retainer plate holding the slippers and biasing the slippers into contact with the swash plate to maintain the swash plate in fixed axial position, the swash plate having a cam shaped circumferential edge surface; and, b) an auxiliary pump mounted between the axial ends of the piston pump, the auxiliary pump having a prime mover in contact with the cam shaped edge of the swash plate.

2. The pump assembly of claim 1 wherein the swash plate has one axial end generally perpendicular to the longitudinal centerline of the input shaft and an opposite swash end inclined at an angle to the longitudinal centerline with the circumferential cam edge between the ends, and the piston pump having a housing containing a cylindrical shaft inlet passage at one axial end terminating in an swash plate chamber containing the swash plate, the intersection of the intermediate chamber and the inlet passage defining an annular seat surface and a thrust bearing between the annular seat surface and the axial end of the swash plate.

3. The pump assembly of claim 2 wherein the thrust bearing has a Teflon coating adjacent the swash plate.

4. The pump assembly of claim 3 wherein the pump shaft is journaled only in a sleeve bearing pressed into the shaft inlet passage and the spring biased retainer plate maintains the swash plate against the thrust plate.

5. The pump of claim 4 wherein the pump shaft and swash plate is a unitary structure and the pump housing is a unitary structure.

6. The combination of an axial piston pump coupled to an auxiliary pump comprising:

a pump housing having a configured central chamber generally symmetrical about a longitudinal axis extending through the housing; the central chamber having a generally cylindrical inlet passage at one longitudinal end of the pump housing, a cylinder chamber at the opposite longitudinal end of the pump housing and a swash plate chamber between and connecting the inlet passage and cylinder chamber; and an end plate adjacent the opposite longitudinal end of the pump housing closing the cylinder chamber;

an annular, non-rotatable cylinder fixed to the pump housing containing a plurality of piston bores extending therethrough and circumferentially spaced about the longitudinal axis; a piston axially moveable within each bore having a spherical end extending through the piston bore and journaled in a slipper and the other end in valved communication with a pump outlet formed in the end plate;

a tail shaft received within the cylinder centered about the longitudinal axis; a spherical bearing having a central opening receiving the tail shaft and a spring biasing the spherical bearing in a direction of the tail shaft;

a retainer plate having a central opening smaller than the outside spherical diameter of the spherical bearing receiving the spherical bearing so that the retainer plate can variably swivel about the spherical bearing, the retainer plate having a plurality of circumferential spaced openings equal to the plurality of pistons and through which the slippers are received and retained;

an inlet shaft rotatably journaled in the inlet passage;

a swash plate within the swash plate chamber integral with the inlet shaft and rotatable with the inlet shaft; the spring biasing the slippers into contact with the swash plate through the retainer plate, and the swash plate having an outer circumferential edge formed as a cam surface;

the pump housing further having a pump drive passage extending from outside the housing in communication with the swash plate chamber; and, an auxiliary pump mounted to the pump housing, the auxiliary pump having a prime mover axially movable by the cam surface along the circumferential edge of the swash plate.

7. The combination of claim 6 wherein the intersection of the inlet shaft passage and the swash plate chamberforms an annular seat surface; the swash plate having a flat annular end surface adjacent the annular seat surface at one axial end thereof and a swash surface in contact with the slippers at its opposite end and an annular thrust bearing between the flat annular end surface of the swash plate and the housing's annular seat surface.

8. The combination of claim 7 wherein a sleeve bearing pressed within the inlet shaft passage supports the inlet shaft.

9. The combination of claim 8 wherein the sleeve bearing and the thrust bearing have a Teflon coating adjacent, respectively, the inlet shaft and the annular end surface of the swash plate, a metallic wear surface adjacent the Teflon coating and a base metal surface adjacent the metallic wear surface.

10. The combination of claim 9 wherein the swash plate and the inlet shaft is a unitary structure and the pump housing is a single casting.

11. An axial piston pump capable of driving an auxiliary pump attached thereto comprising:

a pump housing having a configured central chamber generally symmetrical about a longitudinal axis extending through the housing; the central chamber having a generally cylindrical inlet passage at one longitudinal end of the pump housing, a cylinder chamber at the opposite longitudinal end of the pump housing and a swash plate chamber between and connecting the inlet passage and cylinder chamber, the intersection of the swash plate chamber with the inlet passage defining an annular seat surface in the housing; and an end plate adjacent the opposite longitudinal end of the pump housing closing the cylinder chamber;

an annular, non-rotatable cylinder fixed to the pump housing containing a plurality of piston bores extending therethrough and circumferentially spaced about the longitudinal axis; a piston axially moveable within each bore having a spherical end extending through the piston bore and journaled in a slipper and the other end in valved communication with a pump outlet formed in the end plate;

a sleeve bearing pressed into the inlet passage;

an inlet shaft rotatably journaled only by the sleeve bearing;

the swash plate having a swash surface at one axial end thereof in contact with the slippers, a flat annular end surface at its opposite axial end and a circumferential cam edge surface between the swash surface and the flat annular end surface;

an annular thrust bearing between the housing's annular seat surface and the swash plate's annular end surface; and, the pump housing having a pump drive passage extending from outside the pump housing to the swash plate chamber whereby the prime mover of an auxiliary pump can be driven by the cam edge of the swash plate.

12. The pump of claim 11 wherein the sleeve bearing and the thrust bearing have a Teflon coating adjacent, respectively, the inlet shaft and the annular end surface of the swash plate, a metallic wear surface adjacent the Teflon coating and a base metal surface adjacent the metallic wear surface.

13. The pump of claim 12 further including a tail shaft received within the cylinder centered about the longitudinal axis; a spherical bearing having a central opening receiving the tail shaft and a spring biasing the spherical bearing in a direction of the tail shaft;

a retainer plate having a central opening smaller than the outside spherical diameter of the spherical bearing receiving the spherical bearing so that the retainer plate can variably swivel about the spherical bearing, the retainer plate having a plurality of circumferential spaced openings equal to the plurality of pistons and through which the slippers are received and retained.

14. The pump of claim 13 wherein the swash plate and the inlet shaft is a unitary structure and the pump housing is a single casting.

* * * * *